US005340327A

United States Patent [19]

Koda

[11] Patent Number: 5,340,327

[45] Date of Patent: Aug. 23, 1994

[54] SOCKETS FOR DISCHARGE LAMP

[75] Inventor: Yoshiharu Koda, Tokyo, Japan

[73] Assignee: Kabushiki Kaisha Denkosha, Tokyo, Japan

[21] Appl. No.: 15,255

[22] Filed: Feb. 8, 1993

Related U.S. Application Data

[63] Continuation of Ser. No. 757,441, Sep. 10, 1991, abandoned.

[30] Foreign Application Priority Data

Apr. 23, 1991 [JP] Japan ..... 3-28137

[51] Int. Cl.[5] ..... H01R 33/08

[52] U.S. Cl. ..... 439/239; 439/236

[58] Field of Search ..... 439/226–229, 439/236, 239–244, 356, 426, 587

[56] References Cited

U.S. PATENT DOCUMENTS

| | | | |
|---|---|---|---|
| 2,654,872 | 10/1953 | Saul et al. | 439/261 |
| 2,709,792 | 5/1955 | Peters | 439/242 |
| 2,888,657 | 5/1959 | Green | 439/242 |
| 3,523,270 | 8/1970 | Cagen | 439/356 |
| 3,571,779 | 3/1971 | Collier | 439/426 |
| 4,758,173 | 7/1988 | Northrop | 439/236 |
| 4,803,600 | 2/1989 | Pepping | 439/236 |
| 4,949,007 | 8/1990 | Takagi et al. | 439/226 |
| 4,994,710 | 2/1991 | Roelevink et al. | 439/236 |

FOREIGN PATENT DOCUMENTS

| | | |
|---|---|---|
| 948797 | 9/1956 | Fed. Rep. of Germany . |
| 3740701 | 6/1989 | Fed. Rep. of Germany . |
| 1358459 | 4/1964 | France . |

*Primary Examiner*—Larry I. Schwartz
*Assistant Examiner*—Hien D. Vu
*Attorney, Agent, or Firm*—Gordon W. Hueschen

[57] ABSTRACT

This invention concerns sockets for a discharge lamp ideal for use in a low-temperature atmosphere, particularly to sockets for a discharge lamp which allow easy replacement of an exhausted discharge lamp with a new supply. In each of the sockets, the socket proper is made to be retained on the discharge lamp by base pins being inserted into insertion holes having a diameter equal to or smaller than the diameter of the base pins. The base pins are then made to be connected to an external power source through the medium of power supply electrodes by an electrification adapter being inserted into an electrification adapter retaining part formed in the socket proper. Owing to the construction described above, the replacement of an exhausted discharge lamp with a new supply can be effected easily by one hand.

3 Claims, 6 Drawing Sheets

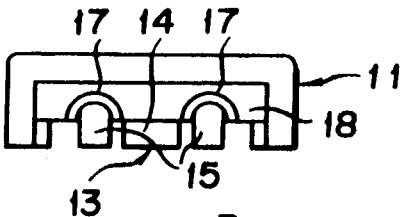
FIG. 3 (A)
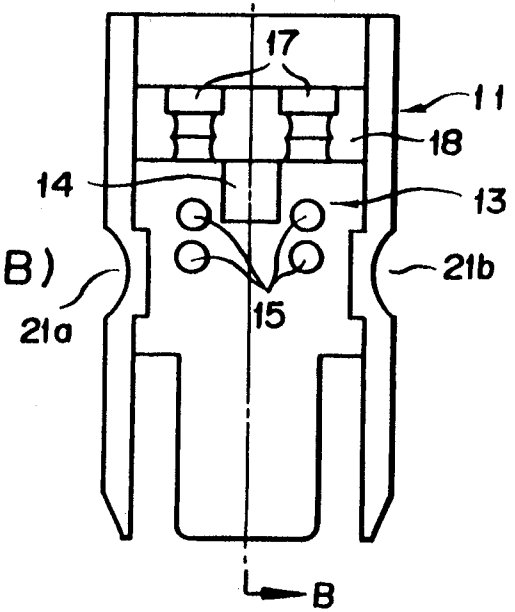
FIG. 3 (B)
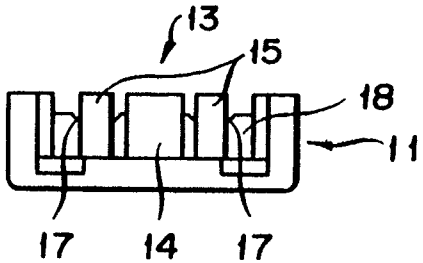
FIG. 3 (C)
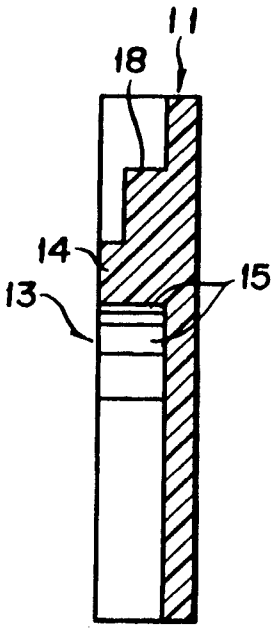
FIG. 3 (D)
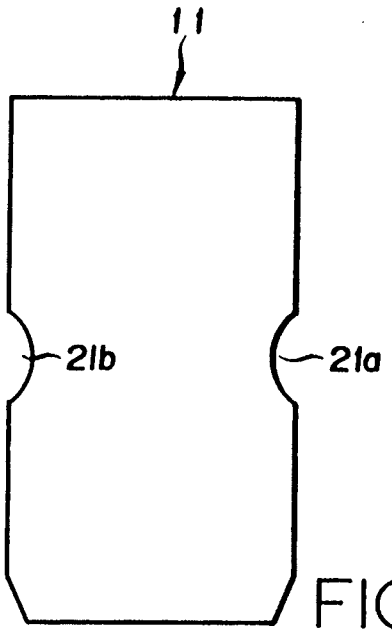
FIG. 3 (E)
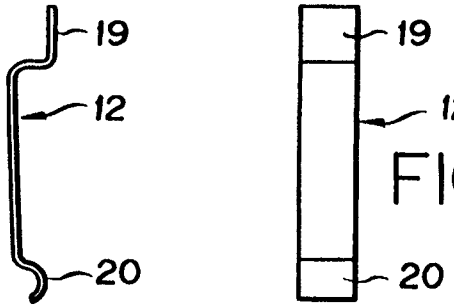
FIG. 4 (A)
FIG. 4 (B)

SOCKETS FOR DISCHARGE LAMP

This application is a continuation of application Ser. No. 07/757,441, filed Sep. 10, 1991 abandoned.

BACKGROUND OF THE INVENTION

1. Field of the Invention

This invention relates to sockets ideal for use with a discharge lamp to be operated in a low-temperature atmosphere and more particularly to sockets for a discharge lamp so constructed as to permit easy replacement of a discharge lamp.

2. Description of the Prior Art

The discharge lamps, especially fluorescent discharge lamps, have been extensively used for general-purpose illumination because they are characterized by enjoying relatively rich luminous energy for small power consumption as compared with incandescent lamps.

The fluorescent discharge lamps which are in popular use are retained in place by having base pins thereof applied fast to the electrodes in the sockets disposed one each at the opposite ends of the lamps. The electric power is supplied via these electrodes to the fluorescent discharge lamps.

When these fluorescent discharge lamps are used in a low-temperature atmosphere, however, they do not produce the desirable illumination which is obtained when they are used under usual conditions. When they are inevitably used in such an adverse atmosphere as described above, therefore, they are usually covered with a pipe capable of keeping them in a warmed state and consequently enabling them to produce the desirable illumination. To be specific, in the covered fluorescent discharge lamps, the heat evolved by the lamps themselves lends itself to elevating the temperature inside the pipes. When a fluorescent discharge lamp is covered with a pipe of this nature, the sockets now in popular use render extremely irksome the replacement of this lamp with a new supply. This is because the replacement requires the fluorescent discharge lamp to be removed simultaneously with the pipe.

SUMMARY OF THE INVENTION

The present invention, conceived with the objective of overcoming the problems of the prior art mentioned above, aims to provide sockets for a fluorescent discharge lamp which, when the fluorescent discharge lamp is in need of replacement with a new supply, permit the replacement to be carried out easily.

To accomplish the object described above, the sockets for a discharge lamp according to this invention each comprise a base-admitting part for admitting a base of the discharge lamp, a pipe-setting part formed on the outer peripheral surface of the base-admitting part and adapted to allow insertion therein of a pipe for keeping the discharge lamp in a warmed state and protecting it against impacts, and electrode pin inserting parts formed on a flat surface wall of the base-admitting part and adapted to permit insertion therein of electrode pins protruding from the base of the discharge lamp and simultaneously allow penetration of the electrode pins in the outer side of the flat wall of the base-admitting part.

The electrode pin-inserting parts are insertion mouths having apertures formed therein in a diameter smaller than or equal to the diameter of the electrode pins protruding from the base of the discharge lamp. To be more specific, the electrode pin-inserting parts each comprise an insertion mouth having a hole or aperture formed therein of a diameter smaller than or equal to the diameter of the electrode pins protruding from the base of the discharge lamp and diameter-enlarging notches extended radially from the insertion mouths and adapted to facilitate enlargement of the diameters of the insertion mouths.

Further, the sockets for a fluorescent discharge lamp according with the present invention each have a socket proper comprising a base-admitting part for admitting a base of the discharge lamp, a pipe-setting part formed on the outer peripheral surface of the base-admitting part and adapted to allow insertion therein of a pipe for keeping the discharged lamp in a warmed state and protecting it against impacts, electrode pin-inserting parts formed on a flat surface wall of the base-admitting part and adapted to permit insertion therein of electrode pins protruding from the base of the discharge lamp and simultaneously allow penetration of the electrode pins in the outer side of the flat surface wall of the base-admitting part, and a current-carrying adapter-retaining part formed outside the flat surface wall and intended to retain in place a current-carrying adapter serving to supply to the discharge lamp the electric power from an external power source via the electrode pins protruding outwardly from the flat surface wall, the current-carrying adapter being provided with power supply electrodes for electrically connecting the external power source to the electrode pins when the current-carrying adapter is retained in place by the current-carrying adapter retaining part of the socket proper, and the current-carrying adapter-retaining part being provided with electrode pressing members serving to press the power supply electrodes against the electrode pins when the current-carrying adapter is retained by the current-carrying adapter-retaining part.

Since the electrode pin-inserting parts, for allowing insertion therein of the electrode pins protruding from the base of the discharge lamp when the discharge lamp is admitted in the base-admitting part, are formed in the flat surface wall of the base-admitting part of the socket proper, the insertion of the electrode pins into the electrode pin-inserting parts causes the socket proper to be retained by the discharge lamp. When the current-carrying adapter is inserted into the current-carrying adapter-retaining part of the socket proper in the ensuant state thereof, the power supply electrodes provided for the current-carrying adapter are pressed against the electrode pins by the electrode-pressing members provided for the current-carrying adapter-retaining part. As a result, the power supply to the discharge lamp by the external power source can be accomplished. The method for attachment of the socket proper in a case such as a show window will be omitted from the following description.

BRIEF DESCRIPTION OF THE DRAWINGS

FIG. 1 (A) being a front view,

FIG. 1 (B) being a cross section taken through FIG. 1 (A) along the line A—A,

FIG. 1 (C) being a rear view, and

FIG. 1 (D) being a top view.

FIG. 3 is a diagram illustrating a current-carrying adapter proper of the sockets for a discharge lamp according with the present invention;

FIG. 3 (A) being a top view,

FIG. 3 (B) being a front view,

FIG. 3 (C) being a plan view,

FIG. 3 (D) being a cross section taken through FIG. 3 (B) along the line B—B, and FIG. 3 (E) being a rear view.

FIG. 4 is a diagram illustrating a power supply electrode incorporated in the current-carrying adapter proper shown in FIG. 3;

FIG. 4 (A) being a side view and

FIG. 4 (B) being a front view.

FIG. 6 (A) being an upper view,

FIG. 6 (B) being a front view,

FIG. 6 (C) being a plane view,

FIG. 6 (D) being a side view, and

FIG. 6 (E) being a rear view.

DETAILED DESCRIPTION OF THE INVENTION

Figure 1:
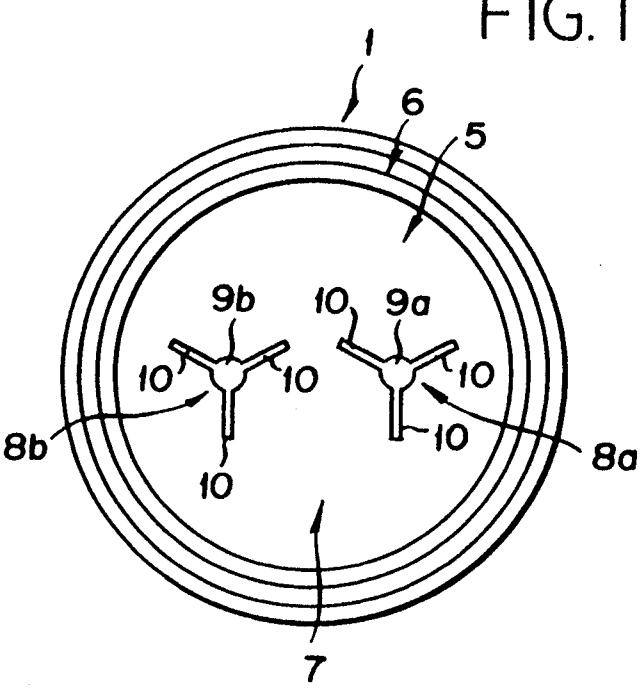
FIG. 1 is a diagram illustrating a socket proper of the sockets for a discharge lamp in accord with the present invention.
Figure 1:
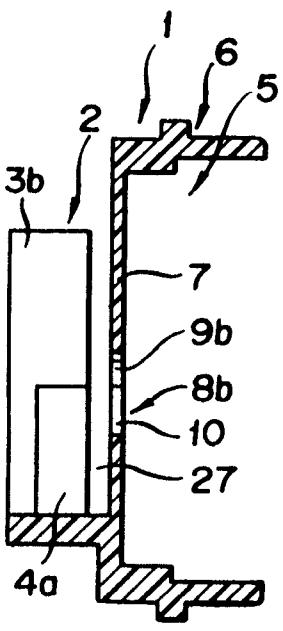
Figure 1:
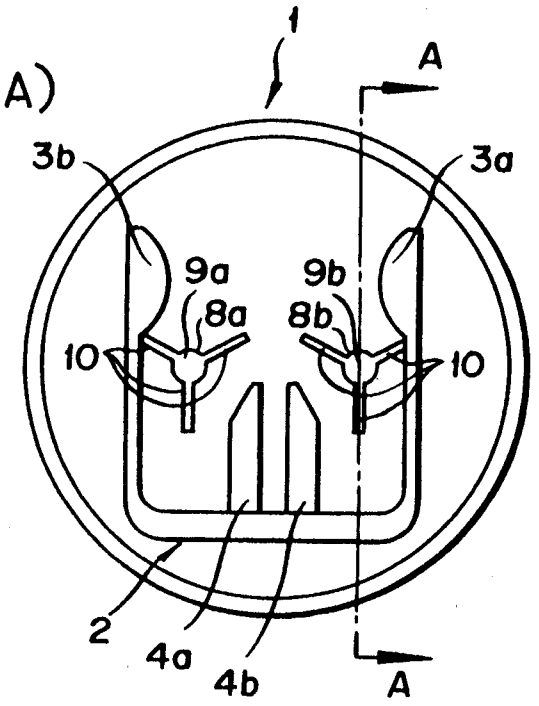
Figure 1:
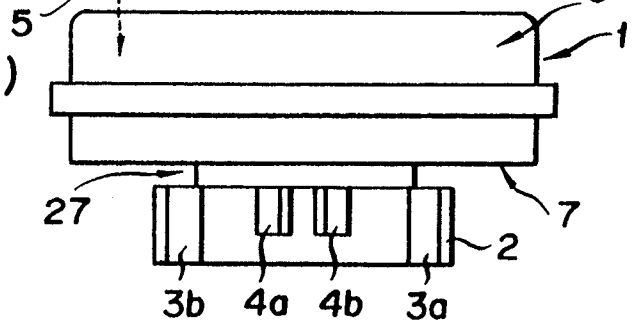
Figure 2:
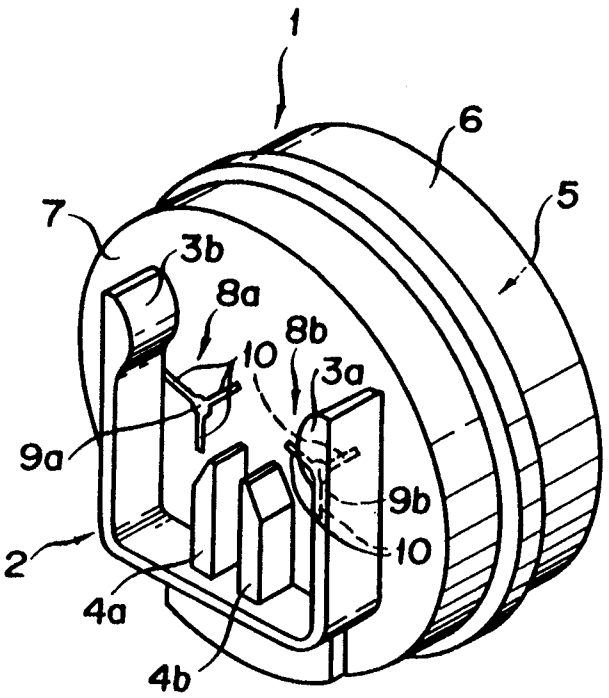
FIG. 2 is a perspective view of the socket proper shown in FIG. 1.

Now, one working example of this invention will be described below with reference to the accompanying drawings. FIGS. 1 (A)–(D) are respectively a front view, a cross section, a rear view, and a top view of the socket proper and FIG. 2 is a perspective view of the socket proper.

As illustrated in these diagrams, a socket proper 1 is provided on the front surface side thereof with a current-carrying adapter-retaining part 2 having attached thereto a current-carrying adapter which will be described specifically hereinbelow. In the current-carrying adapter-retaining part 2, anchoring projections 3*a*, 3*b* are adapted to engage anchoring depressions possessed by the current-carrying adapter and prevent them from slippage and electrode pressing members 4*a*, 4*b* are adapted to force open power-supply electrodes disposed in the current-carrying adapter in consequence of the attachment of the current-carrying adapter. On the rear surface side of the socket proper 1, a base-admitting part 5 for admitting the base of a fluorescent discharge lamp and a pipe-inserting part 6 for allowing insertion therein of a pipe serving to keep the fluorescent discharge lamp in a warmed state and protect it against impacts are provided. On a flat surface wall 7, electrode pin-inserting parts 8*a*, 8*b*, adapted to allow insertion therein of electrode pins protruding from the base of the fluorescent discharge lamp when the base is admitted in the base-admitting part 5, are formed. The electrode pin-inserting parts 8*a*, 8*b* respectively comprise insertion holes, mouths, or apertures 9*a*, 9*b* having a diameter smaller than or equal to the diameter of the electrode pins so as to allow insertion therein of the electrode pins without production of any idle space and sets of hole or aperture diameter enlarging notches 10, 10, and 10 adapted to facilitate this insertion without entailing any distortion of the flat surface wall 7 are laid radially around the insertion holes 9*a*, 9*b* and circumferentially spaced at a substantially uniform angular interval.

In the socket proper 1, which is constructed as described above, when the base part of the fluorescent discharge lamp (not shown) is admitted in the base-admitting part 5 in such a manner as to accompany insertion of the electrode pins into the electrode pin-inserting parts 8*a*, 8*b*, the electrode pins force open the insertion holes 9*a*, 9*b* until the diameters of the insertion holes 9*a*, 9*b* are equalized with the diameter of the electrode pins while faintly moving in the direction of insertion of the elastic wall intervening between the diameter-enlarging notches 10, 10, and 10. Thereafter, the electrode pins are driven home in the insertion holes 9*a*, 9*b*. Thus, the insertion of the electrode pins is accomplished. As a result, the electrode pins have part thereof held in the insertion holes 9*a*, 9*b* and the rest thereof thrust through the flat surface wall 7 and lodged fast on the front surface side of the socket proper 1, namely on the side on which the current-carrying adapter-retaining part is formed. The socket proper 1, therefore, is finally retained in the base part of the fluorescent discharge lamp so fast that it will not be dislocated in spite of appreciable force.

Figure 5:
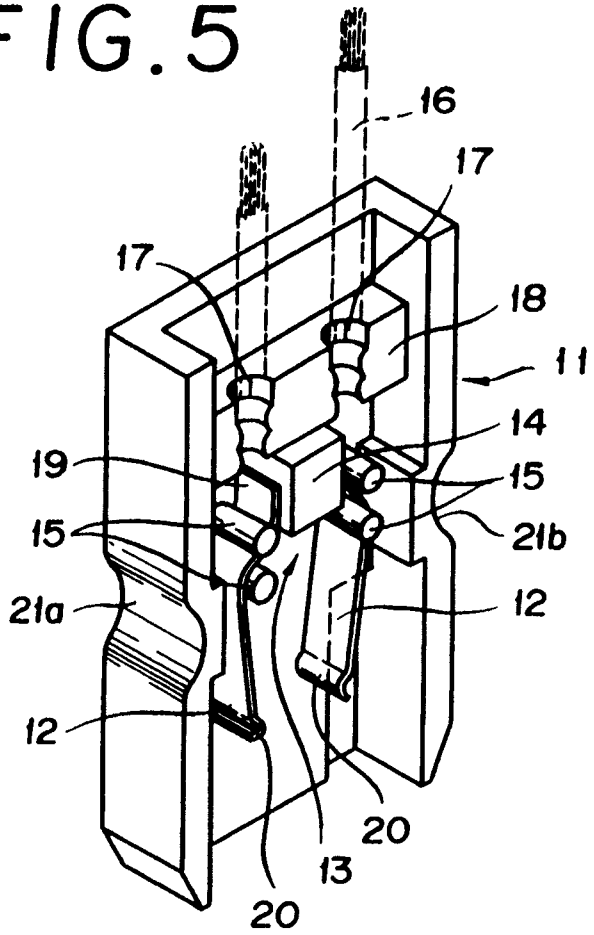
FIG. 5 is a perspective view illustrating the power-supply electrode shown in FIG. 4 as incorporated in the current-carrying adapter proper shown in FIG. 3.
Figure 6:
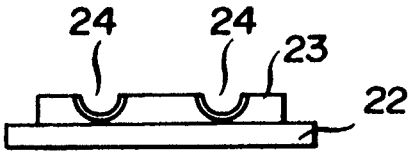
FIG. 6 is a diagram illustrating an current-carrying adapter lid member of the sockets for the discharge lamp in accord with the present invention.
Figure 6:
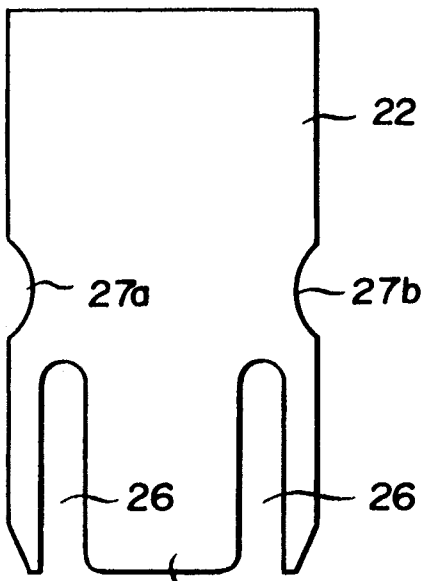
Figure 6:
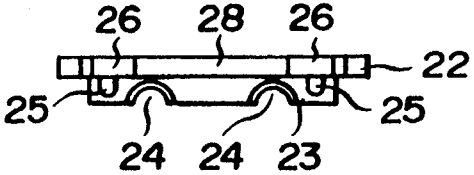
Figure 6:
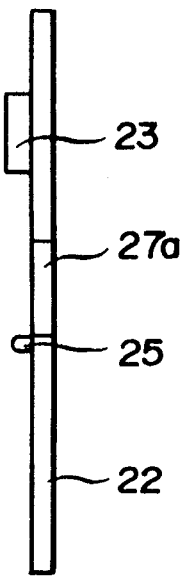
Figure 6:
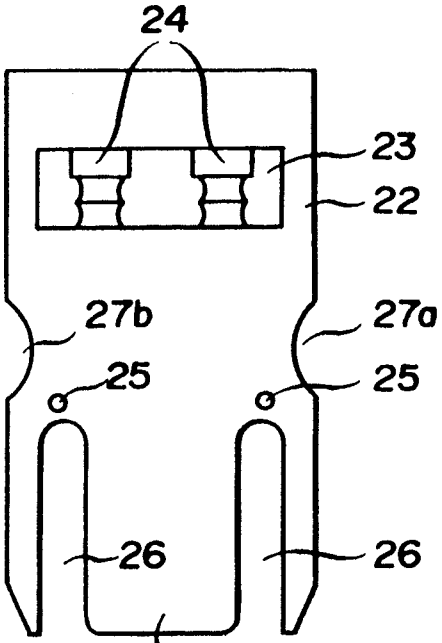
Figure 8:
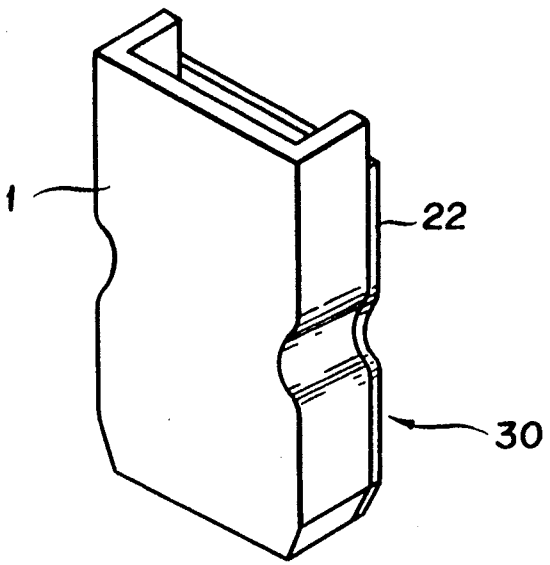
FIG. 8 is a perspective view of a current-carrying adapter of the sockets for the discharge lamp in accord with the present invention.
Figure 7:
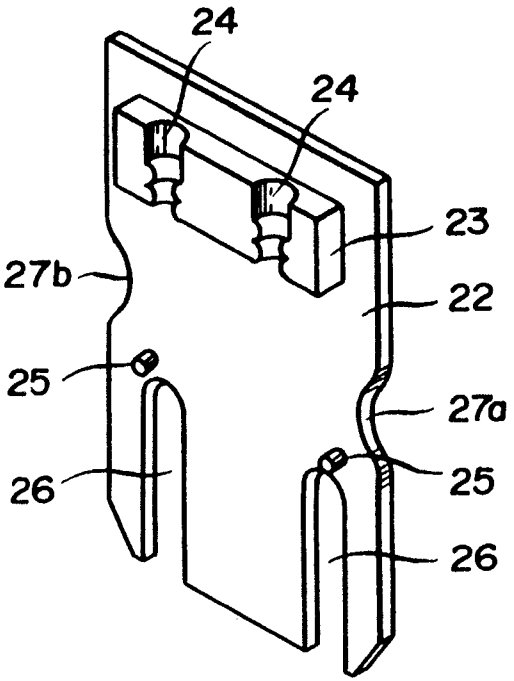
FIG. 7 is a perspective view of the current-carrying adapter lid member shown in FIG. 6.

FIGS. 3 (A) to (E) are diagrams illustrating a current-carrying adapter proper, FIGS. 4 (A) and (B) are diagrams of a power supply electrode to be incorporated in the current-carrying adapter proper, FIG. 5 is a perspective view of the current-carrying adapter proper as posed in the state in which the power supply electrode is incorporated in the current-carrying adapter proper, FIGS. 6 (A) to (E) are diagrams illustrating a current-carrying adapter lid member, FIG. 7 is a perspective view of the current-carrying adapter lid member, and FIG. 8 is a perspective view of a current-carrying adapter to be formed by attaching the current-carrying adapter lid member to the current-carrying adapter proper.

As illustrated in these diagrams, an electrode-nipping part 13 adapted to nip power supply electrodes 12 shown in FIG. 4 and retain them in a prescribed posture is formed on the front surface side of a current-carrying adapter proper 11. The electrode-nipping part 13 comprises a nipping base part 14 with which the terminal parts of the power supply electrodes 12 are adapted to collide and two pairs of nipping columns 15, 15 adapted to collide with the opposite surfaces in the direction of thickness of the nipping base part 14. Above the electrode-nipping part 13 are formed electric cable-retaining parts 17 adapted to pass electric cables 16 serving the purpose of connecting the power supply electrodes 12 to an external power source and press and retain in place the electric cables when a current-carrying adapter lid member specifically described hereinafter is attached to the current-carrying adapter proper 11. The electric cable-retaining parts 17 are formed in a base stand 18 disposed in the current-carrying adapter proper 11 as bored in a diameter substantially equal to or slightly smaller than the diameter of the electric cables 16. The nipping base part 14, the nipping columns 15, and the base stand 18 mentioned above are preferably integrally formed with the current-carrying adapter proper 11 in consideration of the simplicity of assemblage and the maintenance of strength. In the present working example, therefore, they are integrally formed- The power supply electrodes 12 are each formed in a shape as illustrated in FIG. 4, having one terminal part thereof used for the formation of an electric cable-connecting part 19 and one of the opposite surfaces thereof used for collision with the lateral wall of the nipping base part 14 and the other surface thereof for electric connection by soldering to the conductor of the electric cable 16. The power supply electrodes 12 each have the other terminal part thereof used for the formation of a sliding part 20. The sliding parts 20, when the current-carrying adapter proper 11 is attached to the current-carrying adapter-retaining part 2 of the socket proper 1 shown in FIG. 2, slide on the outer surfaces of the electrode pressing members 4*a*, 4*b* and force open the power supply electrodes 12 as the insertion of the electrode pressing members 4*a*, 4*b* progresses. As a result, the central parts of the power supply electrodes 12 are pressed against the lateral surfaces of the electrode pins of the fluorescent discharge lamp (not shown). In the lateral surfaces of the current-carrying adapter proper 11 are formed engaging depressions 21*a*, 21*b* adapted for union with the anchoring projections 3*a*, 3*b* formed on the current-carrying adapter-retaining part 2. Owing to the engaging depressions 21*a*, 21*b*, the attachment of the current-carrying adapter to the socket proper 1 is effected with a clear sensation and the slippage thereof is infallibly ensured.

Figure 9:
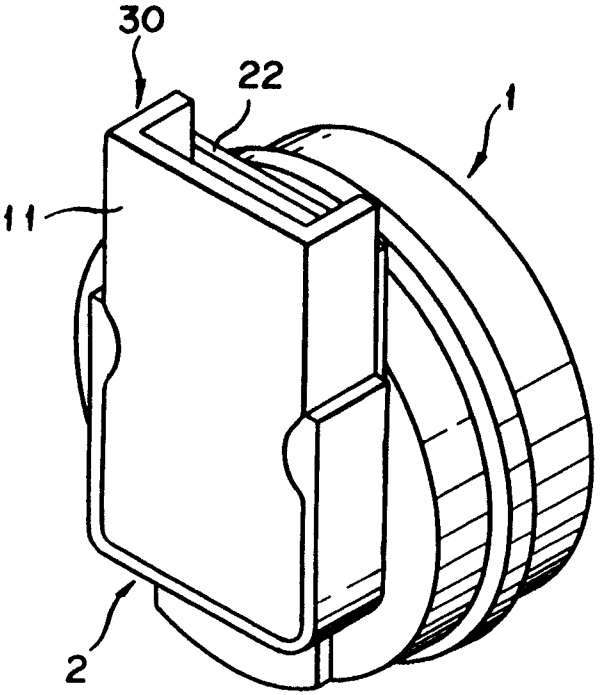
FIG. 9 is a perspective view of the sockets for the discharge lamp according to this invention.

The front surface side of the current-carrying adapter proper 11 is covered with a current-carrying adapter lid proper 22 constructed as illustrated in FIG. 6. On the rear surface side of this current-carrying adapter lid member 22 is formed a base stand 23 adapted to be opposed to the base stand 18 of the current-carrying adapter proper 11. In the base stand 23 are formed electric cable-retaining parts 24 which are adapted similarly to be opposed to the electric cable retaining parts 17. When the current-carrying adapter proper 11 is covered with the current-carrying adapter lid member 22, therefore, the electric cable-retaining parts 17 and 24 are Joined to form openings for passing electric cables and eventually nipping the passed electric cables fast in place. Below the electric cable-retaining parts 24 are disposed electrode-bending protuberances 25. These electrode-bending protuberances 25 are so formed that the fulcrums on which the power supply electrodes 12 are extended when the current-carrying adapter proper 11 is attached to the current-carrying adapter-retaining part 2 will be altered from the nipping columns 15 on the upper side as illustrated in FIG. 2 to these electrode-bending protuberances 25. They serve the purpose of increasing the pressure of the power supply electrodes 12 against the electrode pins and consequently realizing a safe state of electric connection. Below these electrode-bending protuberances 25 are formed guiding notches 26 adapted to guide the electrode pins protruding from the flat surface wall 7 toward the power supply electrodes 12 in consequence of the insertion of the current-carrying adapter proper 11 into the current-carrying adapter-retaining part 2. In the lateral surfaces of the current-carrying adapter lid member 22, engaging depressions 27 are formed one each in the same manner as described above. The current-carrying adapter lid member 22 is attached fast to the current-carrying adapter proper 11 in such a manner as to cover the open side thereof after the power supply electrodes 12 have been set in place in the current-carrying adapter proper 11 and the electric cables 16 have been soldered to the electric cable-connecting parts 19. As a result, the current-carrying adapter proper 11 and the current-carrying adapter lid member 22 are integrated to complete a current-carrying adapter 30 as illustrated in FIG. 8. The current-carrying adapter 30 constructed as described above is attached to the current-carrying adapter retaining part 2 of the socket proper 1 as illustrated in FIG. 9. In the course of this attachment, the current-carrying adapter lid member 22 is inserted in a gap, part which is formed between the current-carrying adapter-retaining part 2 and the flat surface wall 7 as illustrated in FIG. 1. As a result, a slip preventing wall 28 which is necessarily formed between the guiding notches 26 for guiding the electrode pins to the power supply electrodes 12 as illustrated in FIG. 6 forces its way between the electrode pressing members 4*a*, 4*b* and the flat surface wall 7 as illustrated in FIG. 1. Thus, the current-carrying adapter 30 is prevented from slipping off in the direction of the front surface of the socket proper 1. The prevention of the skippage thereof on the side opposite the direction of insertion is attained by virtue of the engaging projections 3*a*, 3*b*.

Figure 10:
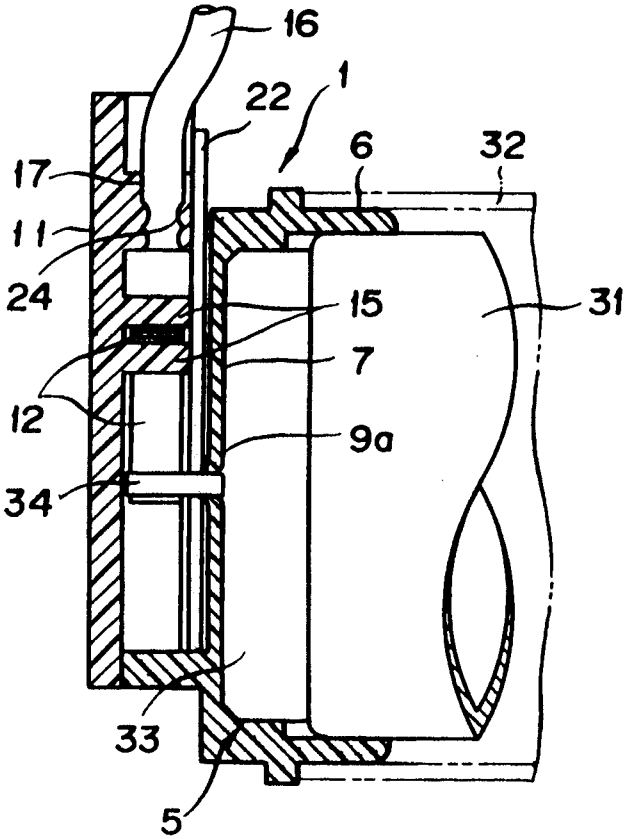
FIG. 10 is a cross section of the sockets for the discharge lamp as posed where the discharge lamp is retained in the state illustrated in FIG. 9.

When the fluorescent discharge lamp and the pipe have been attached to the socket proper 1 and the current-carrying adapter 30 has been attached to the socket proper 1, the resultant assembly assumes a cross section as illustrated in FIG. 10. A pipe 32 for retaining a fluorescent discharge lamp 31 in a warmed state and protecting it against impacts is Joined by insertion to the pipe-inserting part 6 of the socket proper 1. The base-accommodating part 5 of the socket 1 admits a base 33 of the fluorescent discharge lamp 31. Electrode pins 34 protruding from the base 33 are passed through the insertion holes 9*a*, 9*b* formed in the flat surface wall 7. The power supply electrodes 12 are pressed against the lateral surfaces of the electrode pins 34. The supply of electric power to the fluorescent discharge lamp, therefore, is accomplished via a path which extends from the electric cables 16 through the power supply electrodes 12 to the electrode pins 34, In the sockets for a discharge lamp constructed as described above, the removal of an exhausted fluorescent discharge lamp 31 for replacement with a new supply is accomplished by first extracting the current-carrying adapter retaining part 2 from the current-carrying adapter 30, keeping the pipe 32 firmly in place, and drawing the socket proper 1 out of the electrode pins 34. As a result, the fluorescent discharge lamp 31 is ready for removal. The attachment of a fluorescent discharge lamp as a new supply to the sockets is accomplished by first fitting the socket proper 1 to the fluorescent discharge lamp 31 while inserting the electrode pins 34 into the insertion holes 9*a*, 9*b* and then attaching the current-carrying adapter 30 to the current-carrying adapter-retaining part 2. As described above, the attachment and the detachment of the fluorescent discharge lamp 31 are carried out very easily.

Though the working example cited above has been described as adapted for a fluorescent discharge lamp, the present invention naturally can be applied to other species of discharge lamps on the sole condition that the spirit of the invention can be utilized therein.

What is claimed is:

1. In a socket for a discharge lamp having electrode pins of a selected diameter protruding from a base thereof, the socket including a base receiving element for receiving the base of the discharge lamp and a flat surface wall of insulating material having a first exposed surface having insertion apertures therein of selected diameters for receiving said electrode pins therethrough, the improvement comprising:

said socket being of unitary construction and receiving the base of the discharge lamp in direct juxtaposition with the flat surface wall with the electrode pins being in direct contact with the walls of the insertion apertures, the insertion apertures, being in the form of open holes when undeformed each including insertion-aperture-enlarging notches defined by spaced, opposed surfaces in the insulating material extending from said insertion apertures, the diameter of the apertures, when undeformed, being less than the diameter of the pins and the notches facilitating enlargement of the diameter of the insertion apertures upon slight deflection of portions of the flat surface wall proximate the insertion apertures in the direction of insertion during insertion of the electrode pins through the insertion apertures when the base of the lamp is inserted in the socket, wherein the notches are three in number and extend radially from the holes when the pins are inserted in the holes.

2. The improvement of claim 1, wherein the flat surface wall includes a first surface which is the surface in juxtaposition with the base of the discharge lamp and a second surface opposed to the first surface, which second surface includes means for interlocking with a source of electrical current comprising a pair of electrical contacts therein engageable directly by the electrode pins protruding from the base of the discharge lamp and through the insertion apertures of in the flat surface wall of the socket.

3. The improvement of claim 2, wherein the socket has an outer wall thereon with a peripheral rib, the outer wall having a diameter substantially equal to an inner diameter of a pipe-inserting part which is received over the outer wall so that the pipe extends from the socket in coaxial relationship with the discharge lamp.

* * * * *

UNITED STATES PATENT AND TRADEMARK OFFICE

CERTIFICATE OF CORRECTION

PATENT NO. : 5,340,327
DATED : August 23, 1994
INVENTOR(S) : Yoshiharu Koda

It is certified that error appears in the above-indentified patent and that said Letters Patent is hereby corrected as shown below:

Column 4, line 28; "part is" should read -- part 2 is --
Column 5, line 5; "formed-" should read -- formed. --
Column 5, line 44; "Joined" should read -- joined --
Column 6, line 23; "skippage" should read -- slippage --
Column 6, line 32; "Joined" should read -- joined --

Signed and Sealed this
Seventh Day of February, 1995

*Attest:*

Bruce Lehman

BRUCE LEHMAN

*Attesting Officer*

*Commissioner of Patents and Trademarks*